US008723013B2

(12) United States Patent
Tabata

(10) Patent No.: US 8,723,013 B2
(45) Date of Patent: May 13, 2014

(54) MUSICAL PERFORMANCE DEVICE, METHOD FOR CONTROLLING MUSICAL PERFORMANCE DEVICE AND PROGRAM STORAGE MEDIUM

(71) Applicant: Casio Computer Co., Ltd., Tokyo (JP)

(72) Inventor: Yuji Tabata, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/797,725

(22) Filed: Mar. 12, 2013

(65) Prior Publication Data

US 2013/0239785 A1 Sep. 19, 2013

(30) Foreign Application Priority Data

Mar. 15, 2012 (JP) ..... 2012-059470

(51) Int. Cl.
*G10H 1/18* (2006.01)

(52) U.S. Cl.
USPC ..... 84/615; 84/653

(58) Field of Classification Search
USPC ..... 84/615, 653
See application file for complete search history.

(56) References Cited

U.S. PATENT DOCUMENTS

| | | | | | |
|---|---|---|---|---|---|
| 4,341,140 | A * | 7/1982 | Ishida | 84/711 |
| 4,968,877 | A * | 11/1990 | McAvinney et al. | 250/221 |
| 5,017,770 | A * | 5/1991 | Sigalov | 250/221 |
| 5,081,896 | A * | 1/1992 | Hiyoshi et al. | 84/600 |
| 5,369,270 | A * | 11/1994 | Gurner et al. | 250/221 |
| 5,414,256 | A * | 5/1995 | Gurner et al. | 250/221 |
| 5,442,168 | A * | 8/1995 | Gurner et al. | 463/36 |
| 5,475,214 | A * | 12/1995 | DeFranco et al. | 250/221 |
| 6,028,594 | A * | 2/2000 | Inoue | 345/173 |
| 6,222,465 | B1 * | 4/2001 | Kumar et al. | 341/20 |
| RE37,654 | E * | 4/2002 | Longo | 84/626 |
| 6,388,183 | B1 * | 5/2002 | Leh | 84/645 |
| 6,492,775 | B2 * | 12/2002 | Klotz et al. | 315/120 |
| 6,960,715 | B2 * | 11/2005 | Riopelle | 84/725 |
| 7,402,743 | B2 * | 7/2008 | Clark et al. | 84/615 |
| 7,723,604 | B2 * | 5/2010 | Bang et al. | 84/615 |
| 7,799,984 | B2 * | 9/2010 | Salter | 84/477 R |
| 8,198,526 | B2 * | 6/2012 | Izen et al. | 84/743 |
| 8,477,111 | B2 * | 7/2013 | Lim | 345/173 |
| 2001/0035087 | A1 * | 11/2001 | Subotnick | 84/600 |
| 2003/0159567 | A1 * | 8/2003 | Subotnick | 84/626 |
| 2007/0000374 | A1 * | 1/2007 | Clark et al. | 84/724 |
| 2007/0256546 | A1 * | 11/2007 | Hikino et al. | 84/615 |
| 2009/0318225 | A1 * | 12/2009 | Yamaguchi et al. | 463/32 |
| 2012/0144979 | A1 * | 6/2012 | Tansley | 84/645 |

FOREIGN PATENT DOCUMENTS

JP 3599115 B2 12/2004

* cited by examiner

*Primary Examiner* — David S. Warren
(74) *Attorney, Agent, or Firm* — Holtz, Holtz, Goodman & Chick, PC

(57) ABSTRACT

An object of the present invention is to provide a musical performance device capable of changing layout information, such as information regarding the arrangement of a virtual musical instrument set, by an intuitive operation. In the present invention, when position coordinates detected at a shot timing are within one of the areas of a plurality of virtual pads, a CPU designates a virtual pad in this area as a target of positional change. Then, the CPU determines a position where the virtual pad designated as a target of positional change is placed by this positional change, based on position coordinates detected at shot timings, and changes the position of the virtual pad designated as a target of positional change to the determined position.

3 Claims, 12 Drawing Sheets

MUSICAL PERFORMANCE DEVICE, METHOD FOR CONTROLLING MUSICAL PERFORMANCE DEVICE AND PROGRAM STORAGE MEDIUM

CROSS-REFERENCE TO RELATED APPLICATION

This application is based upon and claims the benefit of priority from the prior Japanese Patent Application No 2012-059470, filed Mar. 15, 2012, the entire contents of which is incorporated herein by reference.

BACKGROUND OF THE INVENTION

1. Field of the Invention

The present invention relates to a musical performance device, a method for controlling a musical performance device and a program storage medium.

2. Description of the Related Art

Conventionally, a musical performance device has been proposed which, when a playing movement by an instrument player is detected, generates an electronic sound in response to it. For example, a musical performance device (air drums) is known that generates a percussion instrument sound using only components provided on drumsticks. In this musical performance device, when the instrument player makes a playing movement which is similar to the motion of striking a drum and in which the instrument player holds drumstick-shaped components with a built-in sensor and swings them, the sensor detects the playing movement and a percussion instrument sound is generated.

In this type of musical performance device, the sound of a musical instrument can be emitted without the actual musical instrument. Therefore, the instrument player can enjoy playing music without the limitations of a playing location or a playing space.

As this type of musical performance device, for example, Japanese Patent No. 3599115 discloses a musical instrument gaming device that captures an image of a playing movement made by the instrument player using drumstick-shaped components, displays on a monitor a composite image generated by the captured image of the playing movement and a virtual image showing a musical instrument set being combined, and emits a predetermined musical sound based on the positional information of the drumstick shaped components and the virtual musical instrument set.

However, in the musical instrument gaming device disclosed in Japanese Patent No. 3599115, layout information, such as information regarding the arrangement of the virtual musical instrument set, has been predetermined. Therefore, if this musical instrument gaming device is used as is, the layout information cannot be changed during musical performance, and an increase in the variety of musical performance by the change of the layout information cannot be made.

Here, if a configuration is adopted in which a switch for layout setting is provided in the main body of the musical instrument gaming device and operated, the layout information in the musical instrument gaming device disclosed in Japanese Patent No. 3599115 can be changed. However, in this configuration, when changing the layout information during musical performance, the instrument player is required to operate the switch while viewing an adjustment screen in the main body of the musical instrument gaming device. In other words, the instrument player cannot change the layout information by an intuitive operation.

SUMMARY OF THE INVENTION

The present invention has been conceived in light of the above-described problems. An object of the present invention is to provide a musical performance device, a method for controlling a musical performance device, and a program storage medium by which layout information, such as information regarding the arrangement of a virtual musical instrument set, can be changed by an intuitive operation.

In order to achieve the above-described object, in accordance with one aspect of the present invention, there is provided a musical performance device comprising: a musical performance component which is operable on a virtual plane; a position detecting section which detects position coordinates of the musical performance component on the virtual plane; a storage section which stores layout information including positions of a plurality of areas arranged on the virtual plane and musical tones respectively associated with the plurality of areas; a mode specifying section which specifies one of a position change mode and a musical performance mode; a certain operation position detecting section which detects a position of the musical performance component on the virtual plane when a certain operation is performed by the musical performance component; a judging section which judges whether the position of the musical performance component detected by the certain operation position detecting section is within any one of the plurality of areas arranged based on the layout information; a sound generation instructing section which, when the judging section judges that the position of the musical performance component is within one area of the plurality of areas in the musical performance mode, gives an instruction to emit a musical sound of a musical tone associated with the one area; and a position changing section which, when the judging section judges that the position of the musical performance component is within a given area of the plurality of areas in the position change mode, changes a position of the given area based on the position coordinates detected by the position detecting section, and changes the layout information stored in the storage section based on the changed position.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment of the present invention will hereinafter be described with reference to the drawings.

[Overview of the Musical Performance Device 1]

First, an overview of the musical performance device 1 according to the embodiment of the present invention will be described with reference to FIG. 1A and FIG. 1E.

Figure 1A:
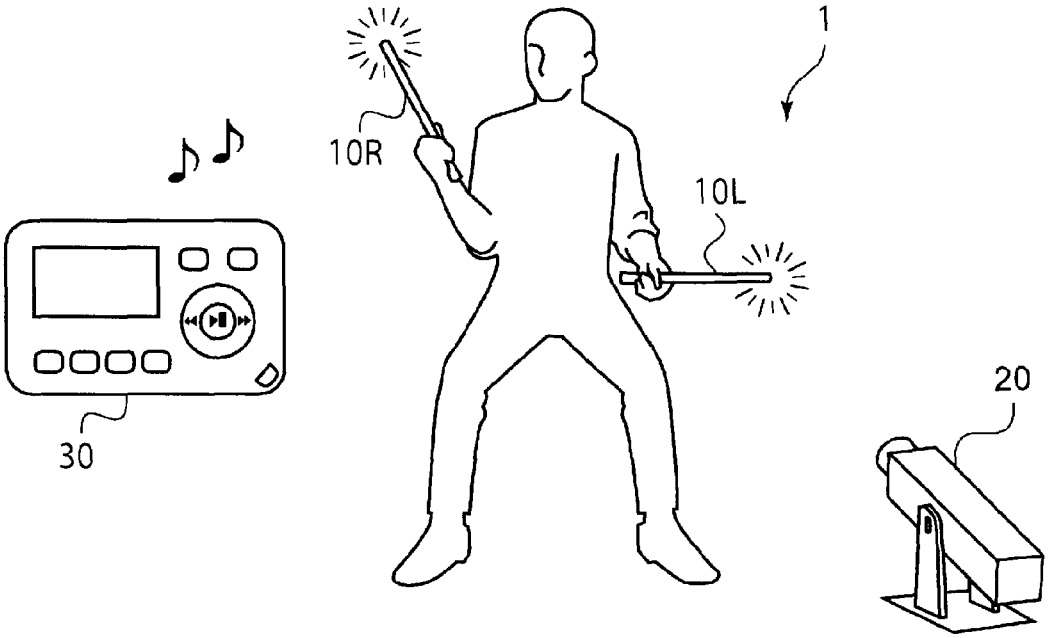
FIG. 1A and FIG. 1B are diagrams outlining a musical performance device according to an embodiment of the present invention.

The musical performance device 1 according to the present embodiment includes drumstick sections 10R and 10L, a camera unit section 20, and a center unit section 30, as shown in FIG. 1A. Note that, although this musical performance device 1 includes two drumstick sections 10R and 10L to actualize a virtual drum performance by two drumsticks, the number of drumstick sections is not limited thereto, and the musical performance device 1 may include a single drumstick section, or three or more drumstick sections. In the following descriptions where the drumstick sections 10R and 10L are not required to be differentiated, these two drumstick sections 10R and 10L are collectively referred to as "drumstick section 10".

The drumstick section 10 is a drumstick-shaped musical performance component that extends in a longitudinal direction. The instrument player holds one end (base end side) of the drumstick section 10 and makes, as a playing movement, a movement in which the drumstick section 10 is swung upwards and downwards with his or her wrist or the like as a fulcrum. In the other end (tip end side) of the drumstick section 10, various sensors such as an acceleration sensor and an angular velocity sensor (motion sensor section 14, described hereafter) are provided to detect this playing movement by the instrument player. The drumstick section 10 transmits a note-ON event to the center unit section 30 based on a playing movement detected by these various sensors.

Also, on the tip end side of the drumstick section 10, a marker section 15 (see FIG. 2) described hereafter is provided so that the camera unit section 20 can recognize the tip of the drumstick section 10 during imaging.

The camera unit section 20 is structured as an optical imaging device. This camera unit section 20 captures a space including an instrument player who is making a playing movement with the drumstick section 10 in hand (hereinafter referred to as "imaging space") as a photographic subject at a predetermined frame rate, and outputs the captured images as moving image data. Then, it identifies the position coordinates of the marker section 15 emitting light within the imaging space, and transmits data indicating the position coordinates (hereinafter referred to as "position coordinate data") to the center unit section 30.

Figure 1B:
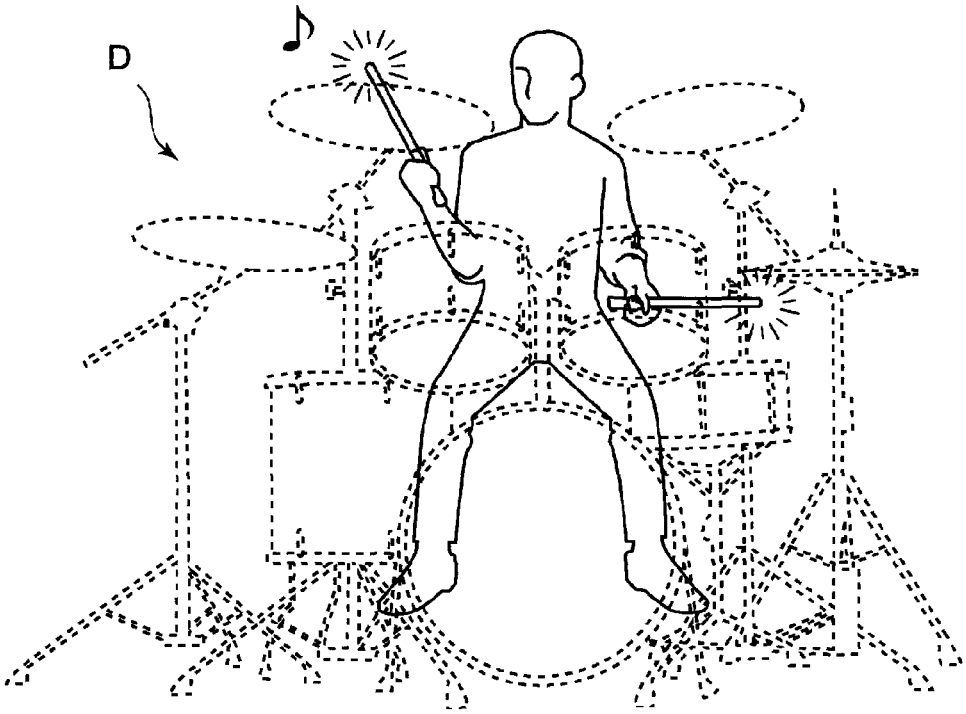

The center unit section 30 emits, when a note-ON event is received from the drumstick section 10, a predetermined musical sound based on the position coordinate data of the marker 15 at the time of the reception of this note-ON event. Specifically, the position coordinate data of a virtual drum set D shown in FIG. 1B has been stored in the center unit section 30 in association with the imaging space of the camera unit section 20, and the center unit section 30 identifies a musical instrument virtually struck by the drumstick section 10 based on the position coordinate data of the virtual drum set D and the position coordinate data of the marker section 15 at the time of the reception of a note-ON event, and emits a musical sound corresponding to the musical instrument.

Next, the structure of the musical performance device 1 according to the present embodiment will be described in detail.

[Structure of the Musical Performance Device 1]

First, the structure of each components of the musical performance device 1 according to the present embodiment, or more specifically, the structures of the drumstick section 10, the camera unit section 20, and the center unit section 30 will be described with reference to FIG. 2 to FIG. 5.

[Structure of the Drumstick Section 10]

Figure 2:
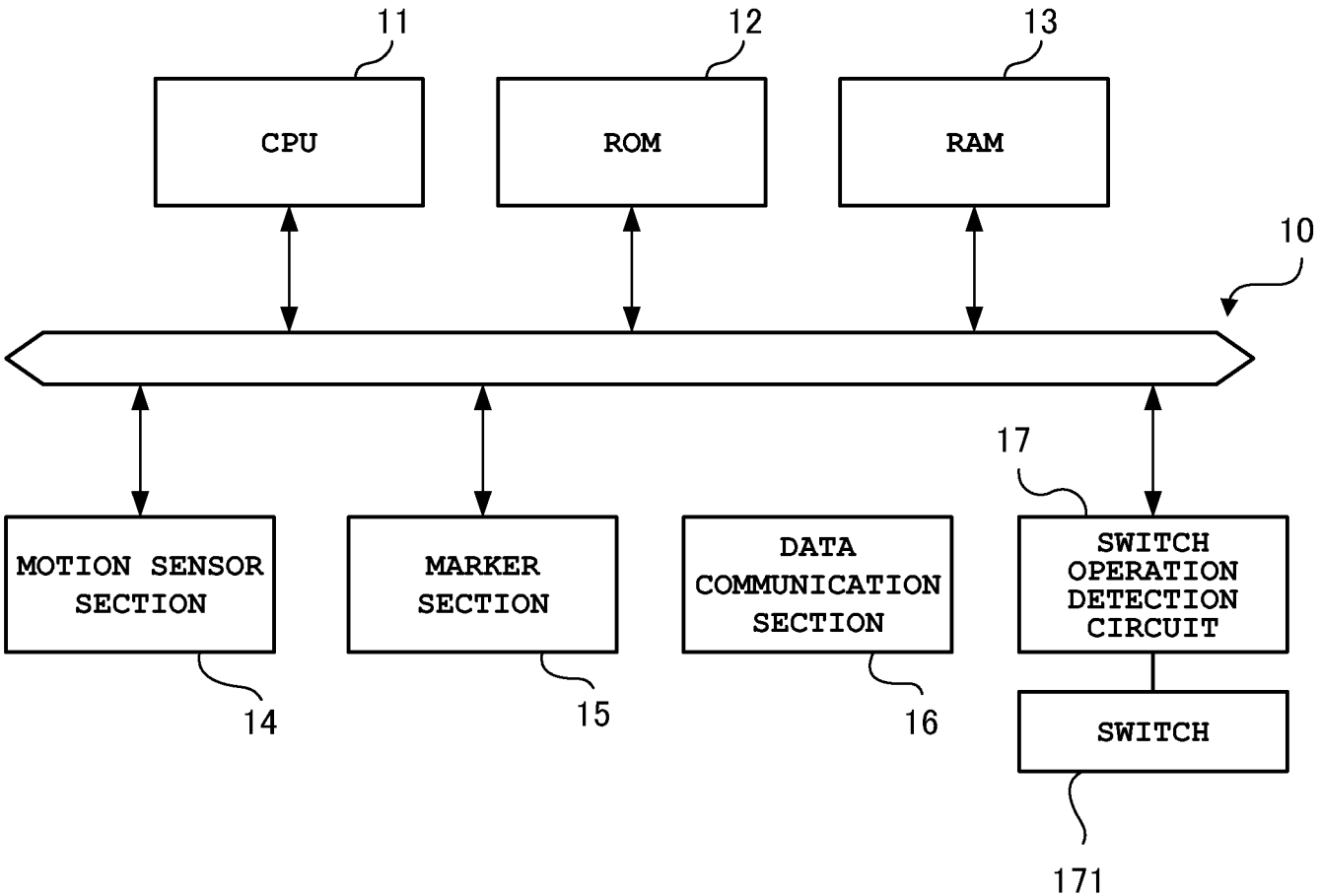
FIG. 2 is a block diagram showing the hardware structure of a drumstick section constituting the musical performance device.

FIG. 2 is a block diagram showing the hardware structure of the drumstick section 10.

The drumstick section 10 includes a Central Processing Unit (CPU) 11, a Read-Only Memory (ROM) 12, a Random Access Memory (RAM) 13, the motion sensor section 14, the marker section 15, a data communication section 16, and a switch operation detection circuit 17, as shown in FIG. 2.

The CPU 11 controls the entire drumstick section 10. For example, the CPU 11 performs the detection of the orientation of the drumstick section 10, shot detection, and action detection based on sensor values outputted from the motion sensor section 14. Also, the CPU 11 controls light-ON and light-OFF of the marker section 15. Specifically, the CPU 11 reads out marker characteristics information from the ROM 12 and performs light emission control of the marker section 15 in accordance with the marker characteristics information. Moreover, the CPU 11 controls communication with the center unit section 30, via the data communication section 16.

The ROM 12 stores processing programs that enable the CPU 11 to perform various processing and marker characteristics information that is used for light emission control of the marker section 15. Here, the camera unit section 20 is required to differentiate between the marker section 15 of the drumstick section 10R (hereinafter referred to as "first marker" when necessary) and the marker section 15 of the drumstick section 10L (hereinafter referred to as "second marker" when necessary). The marker characteristics information is information enabling the camera unit section 20 to differentiate between the first marker and the second marker. For example, shape, size, hue, saturation, luminance during light emission, or flashing speed during light emission may be used as the marker characteristics information.

The CPU 11 of the drumstick section 10R and the CPU 11 of the drumstick section 10L each read out different marker characteristics information and perform light emission control of the respective marker sections 15.

The RAM 13 stores values acquired or generated during processing, such as various sensor values outputted by the motion sensor section 14.

The motion sensor section 14 includes various sensors for detecting the status of the drumstick section 10, and outputs predetermined sensor values. Here, the sensors constituting the motion sensor section 14 are, for example, an acceleration sensor, an angular velocity sensor, and a magnetic sensor.

Figure 3:
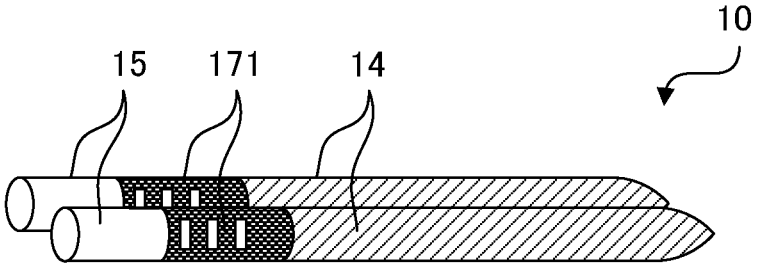
FIG. 3 is a perspective view of the drumstick section.

FIG. 3 is a perspective view of the drumstick section 10, in which a switch section 171 and the marker section 15 have been externally arranged on the drumstick section 10.

The instrument player moves the drumstick section 10 by holding one end (base end side) of the drumstick section 10 and swinging the drumstick section 10 upwards and downwards with the wrist or the like as a fulcrum, during which sensor values based on this movement are outputted from the motion sensor section 14.

When the sensor values are received from the motion sensor section 14, the CPU 11 detects the status of the drumstick section 10 that is being held by the instrument player. For example, the CPU 11 detects timing at which the drumstick section 10 strikes the virtual musical instrument (hereinafter also referred to as "shot timing"). The shot timing denotes a time immediately before the drumstick section 10 is stopped after being swung downwards, at which the acceleration of the drumstick section 10 in the direction opposite to the downward swing direction exceeds a certain threshold value.

Returning to FIG. 2, the marker section 15 is a light-emitting body provided on the tip end side of the drumstick section 10, which is constituted by, for example, a Light Emitting Diode (LED). This marker section 15 is turned ON and OFF under the control of the CPU 11. Specifically, this marker section 15 is lit based on marker characteristics information read out from the ROM 12 by the CPU 11. At this time, the marker characteristics information of the drumstick section 10R and the marker characteristics information of the drumstick section. 10L differ, and therefore the camera unit section 20 can differentiate them and individually acquire the position coordinates of the marker section (first marker) 15 of the drumstick section 10R and the position coordinates of the marker section (second marker) 15 of the drumstick section 10L.

The data communication section 16 performs predetermined wireless communication with at least the center unit section 30. This predetermined wireless communication can be performed by an arbitrary method. In the present embodiment, wireless communication with the center unit section 30 is performed by infrared data communication. Note that the data communication section 16 may perform wireless communication with the camera unit section 20, or may perform wireless communication between the drumstick section 10R and the drumstick section 10L.

The switch operation detection circuit 17 is connected to the switch 171 and receives input information via the switch 171. This input information includes, for example, a signal that serves as a trigger to change the positions of virtual, pads in set layout information described hereafter. The switch 171 is referred to as a "pad position adjustment switch" when necessary.

[Structure of the Camera Unit Section 20]

The structure of the drumstick section 10 is as described above. Next, the structure of the camera unit section 20 will be described with reference to FIG. 4.

Figure 4:
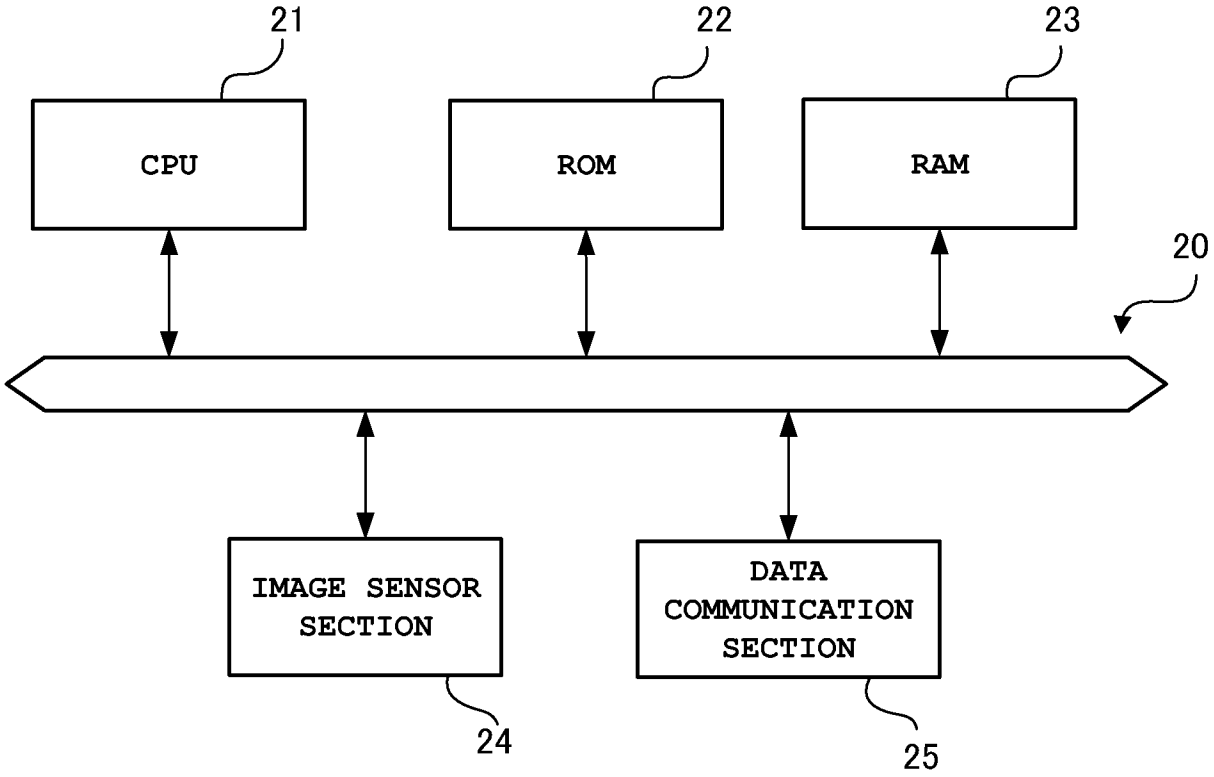
FIG. 4 is a block diagram showing the hardware structure of a camera unit section constituting the musical performance device.

FIG. 4 is a block diagram showing the hardware structure of the camera unit section 20.

The camera unit section 20 includes a CPU 21, a ROM 22, a RAM 23, an image sensor section 24, and a data communication section 25.

The CPU 21 controls the entire camera unit section 20. For example, the CPU 21 controls to calculate the respective position coordinates of the marker sections 15 (first marker and second marker) of the drumstick sections 10R and 10L based on the position coordinate data and the marker characteristics information of the marker sections 15 detected by the image sensor section 24, and output position coordinate data indicating each calculation result. Also, the CPU 21 controls communication to transmit calculated position coordinate data and the like to the center unit section 30, via the data communication section 25.

The ROM 22 stores processing programs enabling the CPU 21 to perform various processing, and the RAM 23 stores values acquired or generated during processing, such as the position coordinate data of the marker section 15 detected by the image sensor section 24. The RAM 23 also stores the respective marker characteristics information of the drumstick sections 10R and 10L received from the center unit section 30.

The image sensor section 24 is, for example, an optical camera, and captures a moving image of the instrument player who is performing a playing movement with the drumstick section 10 in hand, at a predetermined frame rate. In addition, the image sensor section 24 outputs captured image data to the CPU 21 per frame. Note that the identification of the position coordinates of the marker section 15 of the drumstick section 10 within a captured image may be performed by the image sensor section 24, or it may be performed by the CPU 21. Similarly, the identification of the marker characteristics information of the captured marker section 15 may be performed by the image sensor section 24, or it may be performed by the CPU 21.

The data communication section 25 performs predetermined wireless communication (such as infrared data communication) with at least the center unit section 30. Note that the data communication section 25 may perform wireless communication with the drumstick section 10.

[Structure of the Center Unit Section 30]

The structure of the camera unit section 20 is as described above. Next, the structure of the center unit section 30 will be described with reference to FIG. 5.

Figure 5:
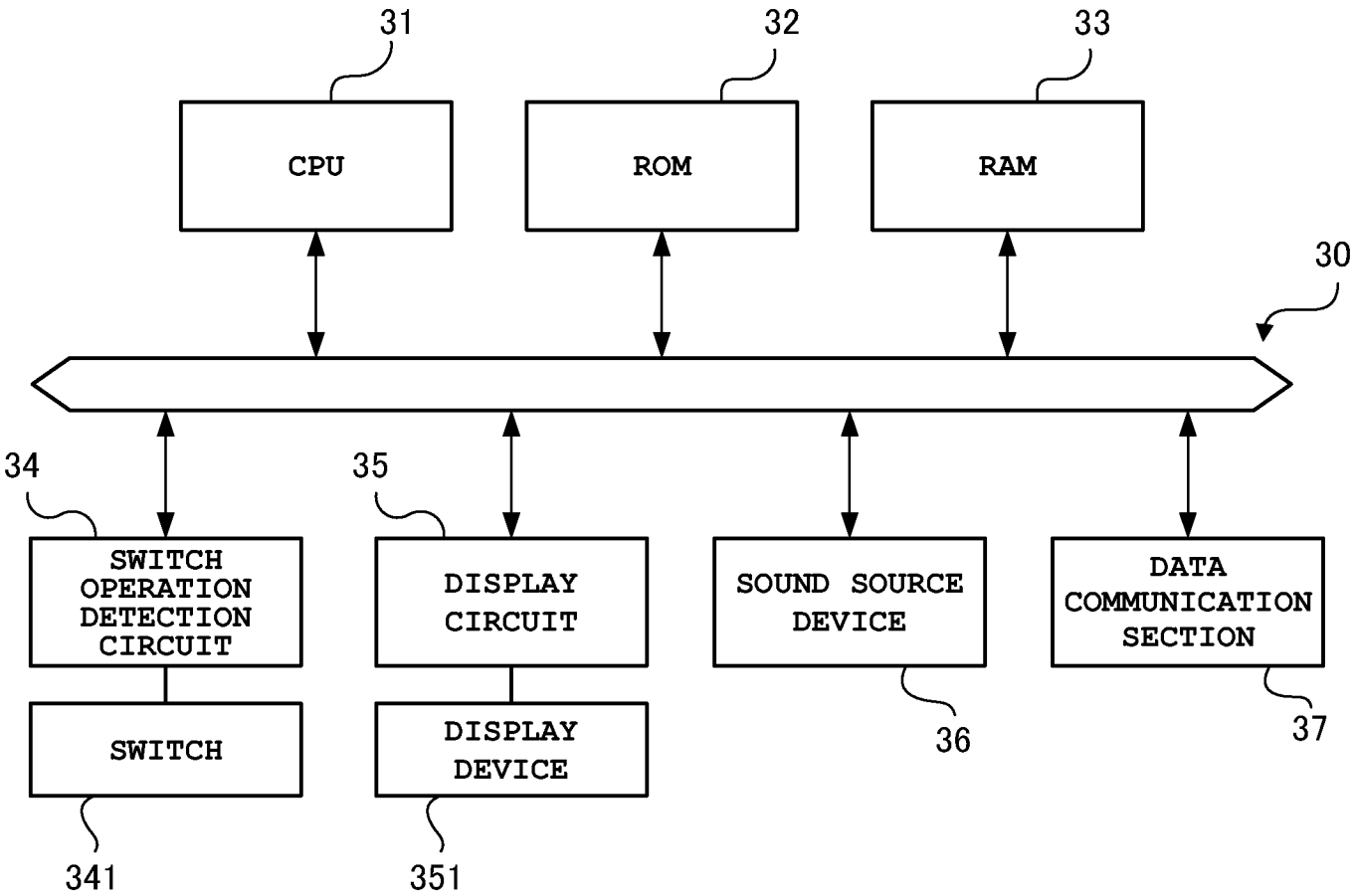
FIG. 5 is a block diagram showing the hardware structure of a center unit section constituting the musical performance device.

FIG. 5 is a block diagram showing the hardware structure of the center unit section 30.

The center unit section 30 includes a CPU 31, a ROM 32, a RAM 33, a switch operation detection circuit 34, a display circuit 35, a sound source device 36, and a data communication section 37.

The CPU 31 controls the entire center unit section 30. For example, the CPU 31 controls to emit a predetermined musical sound or the like based on a shot detection result received from the drumstick section 10 and the position coordinates of the marker section 15 received from the camera unit section 20. Also, the CPU 31 controls communication between the drumstick section 10 and the camera unit section 20, via the data communication section 37.

The ROM 32 stores processing programs for various processing that are performed by the CPU 31. In addition, the ROM 32 stores waveform data of various musical tones, such as waveform data (musical tone data) of wind instruments like the flute, saxophone, and trumpet, keyboard instruments like the piano, string instruments like the guitar, and percussion instruments like the bass drum, high-hat, snare drum, cymbal, and tom-tom, in association with position coordinates.

Figure 6:
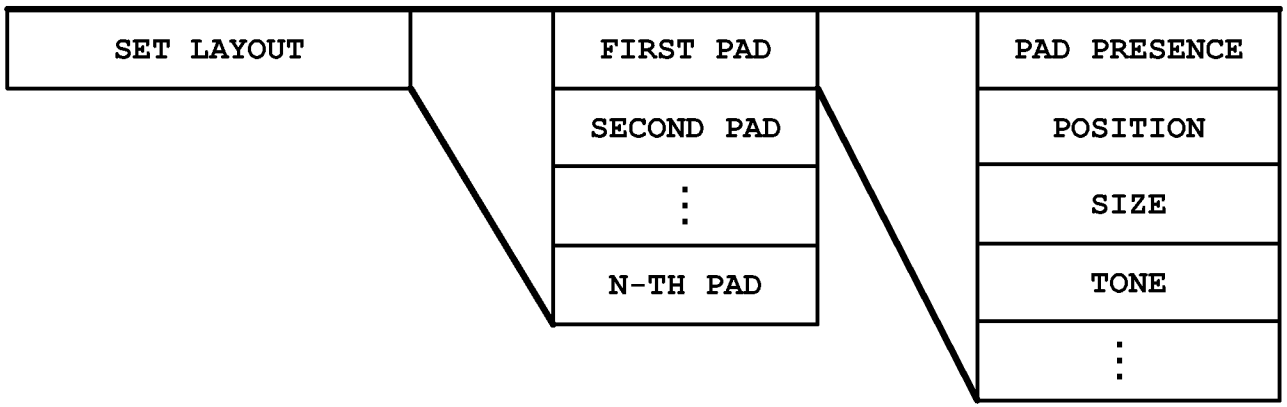
FIG. 6 is a diagram showing set layout information of the musical performance device according to the embodiment of the present invention.

In a method for storing these musical tone data, set layout information includes n-pieces of pad information for first to n-th pads, as shown in FIG. 6. In addition, the presence of a pad (the presence of a virtual pad on a virtual plane described hereafter), the position (position coordinates on the virtual plane described hereafter), the size (shape, diameter, and the like of the virtual pad), the musical tone (waveform data) and the like are stored in association with each piece of pad information.

Figure 7:
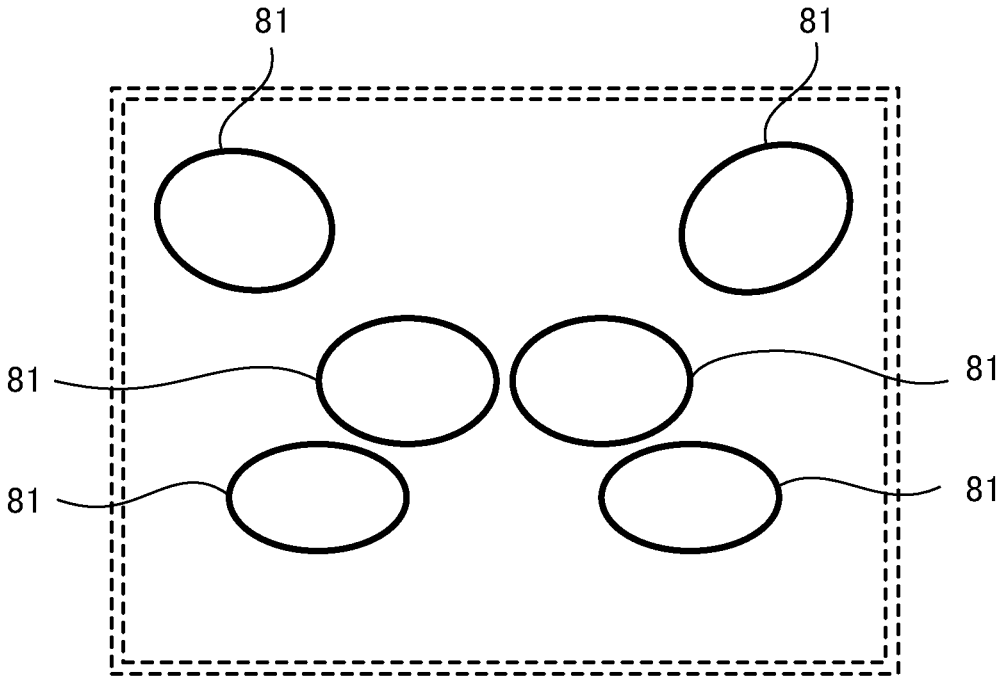
FIG. 7 is a diagram showing a concept indicated by the set layout information, in which the concept has been visualized on a virtual plane.

Here, a specific set layout will be described with reference to FIG. 7. FIG. 7 is a diagram showing a concept indicated by set layout information (see FIG. 6) stored in the ROM 32 of the center unit section 30, in which the concept has been visualized on a virtual plane.

In FIG. 7, six virtual pads 81 have been arranged on a virtual plane. These virtual pads 81 correspond to, among the first to n-th pads, pads whose pad presence data indicates "pad present". For example, six pads, which are a second pad, a third pad, a fifth pad, a sixth pad, an eighth pad, and a ninth pad, correspond to the virtual pads 81. Also, these virtual pads 81 have been arranged based on positional data and size data, and each of which has been associated with musical tone data. Therefore, when the position coordinates of the marker section 15 at the time of shot detection are within an area corresponding to a virtual pad 81, the musical tone associated with the virtual pad 81 is emitted.

Note that the CPU 31 may display this virtual plane and the arrangement of the virtual pads 81 on a display device 351 described hereafter.

Also note that, in the present embodiment, position coordinates on the virtual plane coincide with position coordinates in an image captured by the camera unit section 20.

Returning to FIG. 5, the RAM 33 stores values acquired or generated during processing, such as the status of the drumstick section 10 received from the drumstick section 10 (such as shot detection), the position coordinates of the marker section 15 received from the camera unit section 20, and set layout information read out from the ROM 32.

The CPU 31 read out musical tone data (waveform data) associated with a virtual pad 81 in an area where the position coordinates of the marker section 15 are located at the time of shot detection (or in other words, when a note-ON event is received) from set layout information stored in the RAM 33. As a result, a musical sound based on a playing movement by the instrument player is emitted.

The switch operation detection circuit 34 is connected to a switch 341 and receives input information via the switch 341. The input information includes, for example, information regarding changes in the sound volume and the musical tone of a musical sound to be emitted, information regarding the setting and change of a set layout number, and information regarding switching of display by the display device 351.

The display circuit 35 is connected to the display device 351 and performs display control for the display device 351.

The sound source device 36 reads out waveform data from the ROM 32 in accordance with an instruction from the CPU 31, and after generating musical sound data, converts it to an analog signal, and emits the musical sound from a speaker (not shown).

The data communication section 37 performs predetermined wireless communication (such as infrared data communication) between the drumstick section 10 and the camera unit section 20.

[Processing by the Musical Performance Device 1]

The structures of the drumstick section 10, the camera unit section 20, and the center unit section 30 constituting the musical performance device 1 are as described above. Next, processing by the musical performance device 1 will be described with reference to FIG. 8 to FIG. 11.

[Processing by the Drumstick Section 10]

Figure 8:
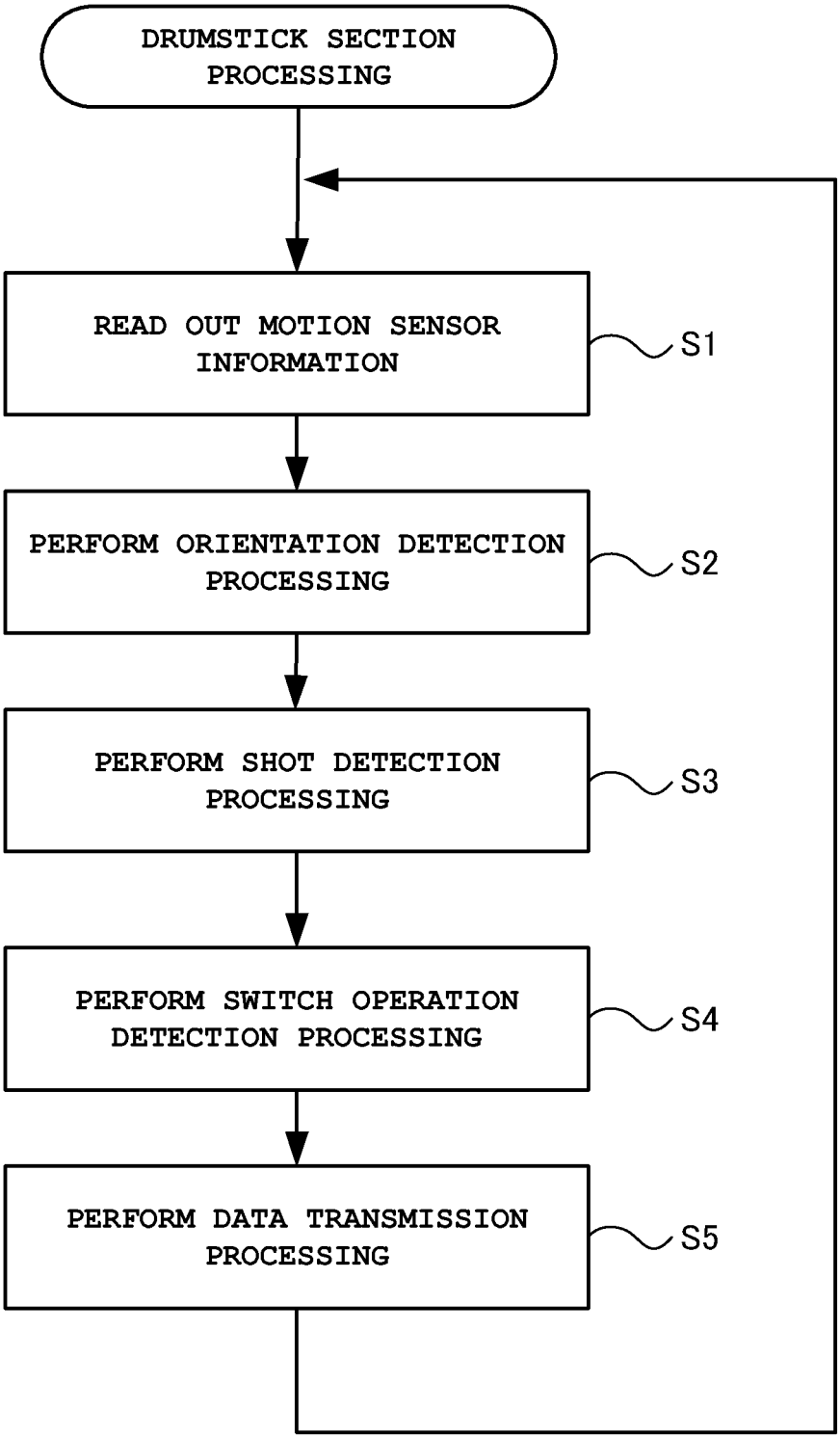
FIG. 8 is a flowchart of processing by the drumstick section.

FIG. 8 is a flowchart of processing that is performed by the drumstick section 10 (hereinafter referred to as "drumstick section processing").

As shown in FIG. 8, the CPU 11 of the drumstick section 10 first reads out motion sensor information from the motion sensor section 14, or in other words, the CPU 11 of the drumstick section 10 reads out sensor values outputted by the various sensors, and stores the sensor values in the RAM 13 (Step S1). Subsequently, the CPU 11 performs orientation detection processing for the drumstick section 10 based on the read out motion sensor information (Step S2). In the orientation detection processing, the CPU 11 calculates the orientation of the drumstick section 10, such as the roll angle and the pitch angle of the stick section 10, based on the motion sensor information.

Then, the CPU 11 performs shot detection processing based on the motion sensor information (Step S3). Here, when playing music using the drumstick section 10, the instrument player generally performs a playing movement that is similar to the motion of striking an actual musical instrument (such as a drum). In this playing movement, the instrument player first swings the drumstick section 10 upwards, and then swings it downward toward the virtual musical instrument. Subsequently, the instrument player applies force to stop the movement of the drumstick section 10 immediately before the drumstick section 10 strikes the virtual musical instrument. At this time, the instrument player is expecting the musical sound to be emitted at the instant the drumstick section 10 strikes the virtual musical instrument. Therefore, it is preferable that the musical sound is emitted at timing expected by the instrument player. Accordingly, in the present embodiment, a musical sound is emitted at the instant the surface of the virtual musical instrument is struck by the instrument player with the drumstick section 10, or at timing slightly prior thereto.

In the present embodiment, the timing of shot detection denotes a time immediately before the drumstick section 10 stops after being swung downwards at which the acceleration of the drumstick section 10 in the direction opposite to the downward swing direction exceeds a certain threshold value.

When judged that the shot detection timing serving as a sound generation timing has come, the CPU 11 of the drumstick section 10 generates a note-ON event and transmits it to the center unit section 30. As a result, sound emission processing is performed by the center unit section 30 and the musical sound is emitted.

In the shot detection processing at Step S3, the CPU 11 generates a note-ON event based on the motion sensor information (such as a sensor resultant value of the acceleration sensor) The note-ON event to be generated herein may include the volume of a musical sound to be emitted, which can be determined from, for example, the maximum value of the sensor resultant value.

Next, the CPU 11 performs switch operation detection processing for detecting the operation of the switch 171 (Step S4). In this processing, when the operation of the switch 171, such as a pressing operation, is performed, the CPU 11 receives a signal indicating that the switch 171 has been operated from the switch operation detection circuit 17, and after setting drumstick switch information to "operation detected", stores it in the RAM 13. Conversely, when a signal indicating that the switch 171 has been operated is not received from the switch operation detection circuit 17, the CPU 11 sets drumstick switch information to "operation not detected" and stores it in the RAM 13.

Next, the CPU 11 transmits information detected by the processing at Step S1 to Step S4, or in other words, the motion sensor information, the orientational information, the shot information, and the drumstick switch information to the center unit section 30 via the data communication section 16 (Step S5) When transmitting, the CPU 11 associates the motion sensor information, the orientational information, the shot information, and the drumstick switch information with the drumstick identification information, and then transmits them to the center unit section 30.

Then, the CPU 11 returns to the processing at Step S1 and repeats the subsequent processing.

[Processing by the Camera Unit Section 20]

Figure 9:
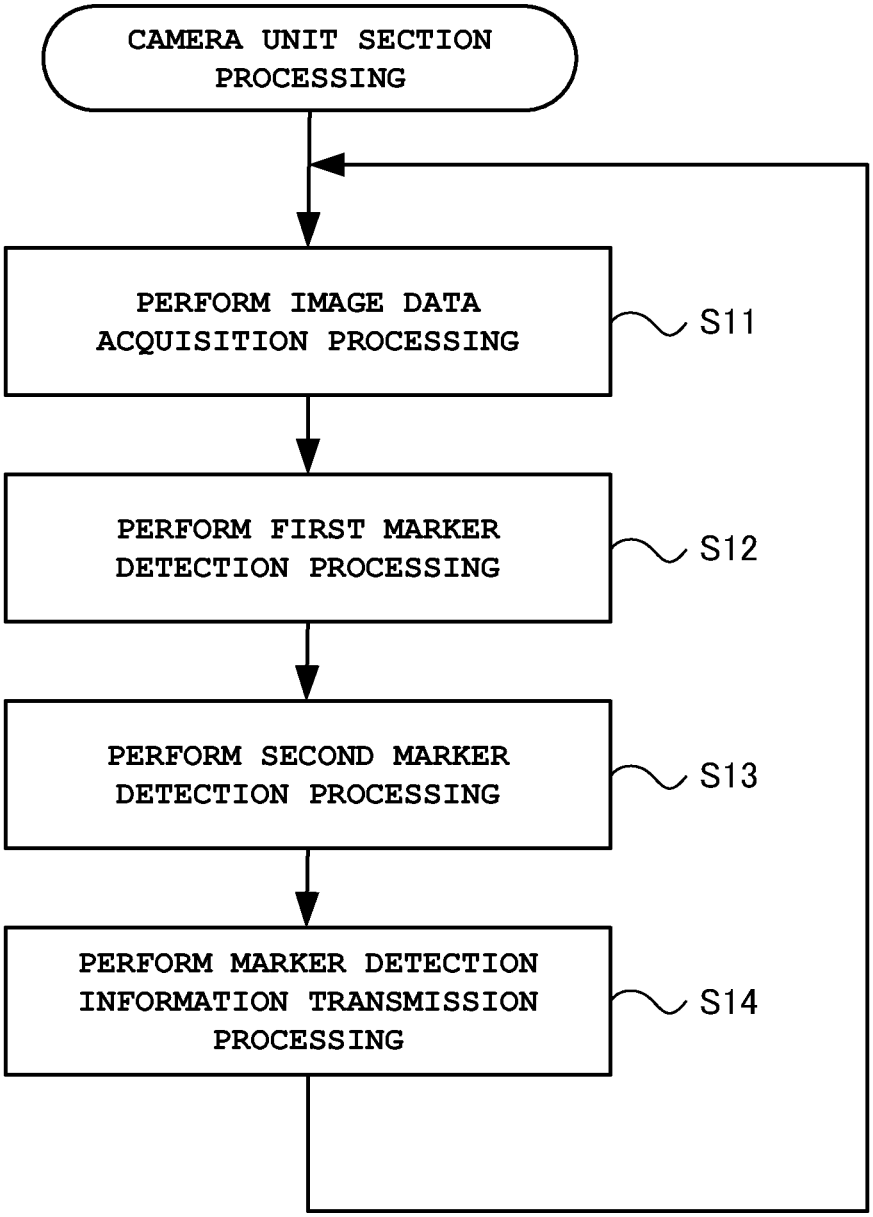
FIG. 9 is a flowchart of processing by the camera unit section.

FIG. 9 is a flowchart of processing that is performed by the camera unit section 20 (hereinafter referred to as "camera unit section processing").

As shown in FIG. 9, the CPU 21 of the camera unit section 20 first performs image data acquisition processing (Step S11). In the image data acquisition processing, the CPU 21 acquires image data from the image sensor section 24.

Next, the CPU 21 performs first marker detection processing (Step S12) and second marker detection processing (Step S13). In the first marker detection processing and the second marker detection processing, the CPU 21 acquires the marker detection information of the marker section 15 (first marker) of the drumstick section 10R and the marker detection information of the marker section 15 (second marker) of the drumstick section 10L which include the position coordinates, the sizes, and the angles thereof and have been detected by the image sensor section 24, and stores the marker detection information in the RAN 23. Note that the image sensor section 24 detects the marker detection information of the lighted marker section 15.

Then, the CPU 21 transmits the marker detection information acquired at Step S12 and Step S13 to the center unit section 30 via the data communication section 25 (Step S14), and returns to the processing at Step S11.

[Processing by the Center Unit Section 30]

Figure 10:
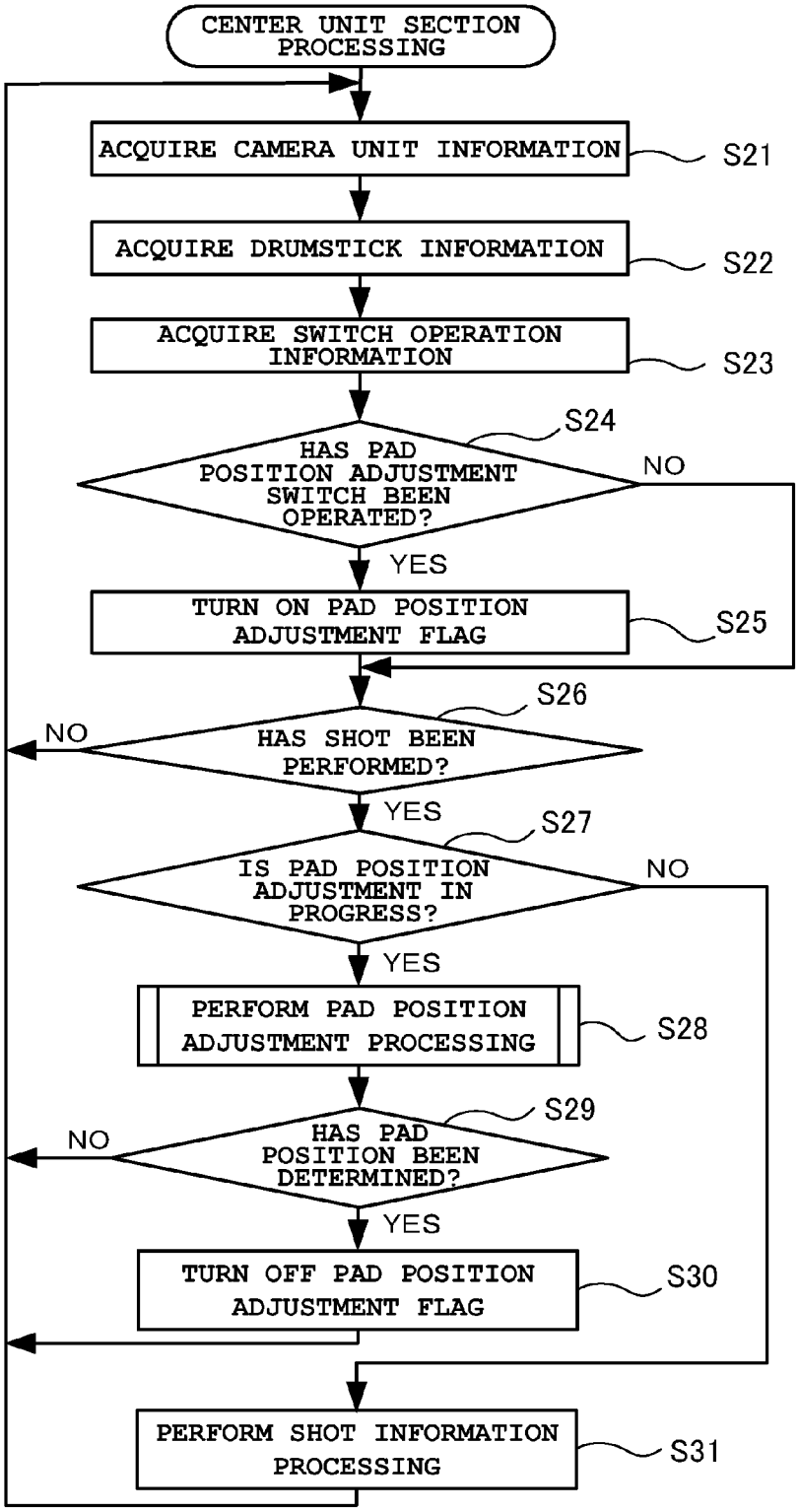
FIG. 10 is a flowchart of processing by the center unit section.

FIG. 10 is a flowchart of processing that is performed by the center unit section 30 (hereinafter referred to as "center unit section processing").

As shown in FIG. 10, the CPU 31 of the center unit section 30 first receives the marker detection information of the first maker and the second marker from the camera unit section 20, and stores them in the RAM 33 (Step S21). In addition, the CPU 31 receives motion sensor information, orientational information, shot information, and drumstick switch information associated with drumstick identification information from each of the drumstick sections 10R and 10L, and stores them in the RAM 33 (Step S22). Moreover, the CPU 31 acquires information inputted by the operation of the switch 341 (Step S23).

Next, the CPU 31 judges whether or not the pad position adjustment switch has been operated (Step S24). The CPU 31 judges that the pad position adjustment switch has been operated when the drumstick switch information received at Step S22 indicates "operation detected".

When a judgment result at Step S24 is YES, the CPU 31 turns ON a pad position adjustment flag (Step S25). Note that, when the pad position adjustment flag is ON and an arbitrary area on the virtual plane is struck, a musical tone associated with a virtual pad 81 to be a target of pad position adjustment at Step S31 described hereafter is emitted.

When a judgment result at Step S24 is NO or after the processing at Step S25, the CPU 31 judges whether or not a shot has been performed (Step S26). In this processing, the CPU 31 judges whether or not a shot has been performed by judging whether or not a note-ON event has been received from the drumstick section 10. When judged that a shot has been performed, the CPU 31 judges whether or not pad position adjustment is in progress (Step S27). Conversely, when judged that a shot has not been performed, the CPU 31 returns to the processing at Step S21.

When the pad position adjustment flag is ON, the CPU 31 judges that pad position adjustment is in progress. When the pad position adjustment flag is OFF, the CPU 31 judges that pad position adjustment is not in progress.

Figure 11:
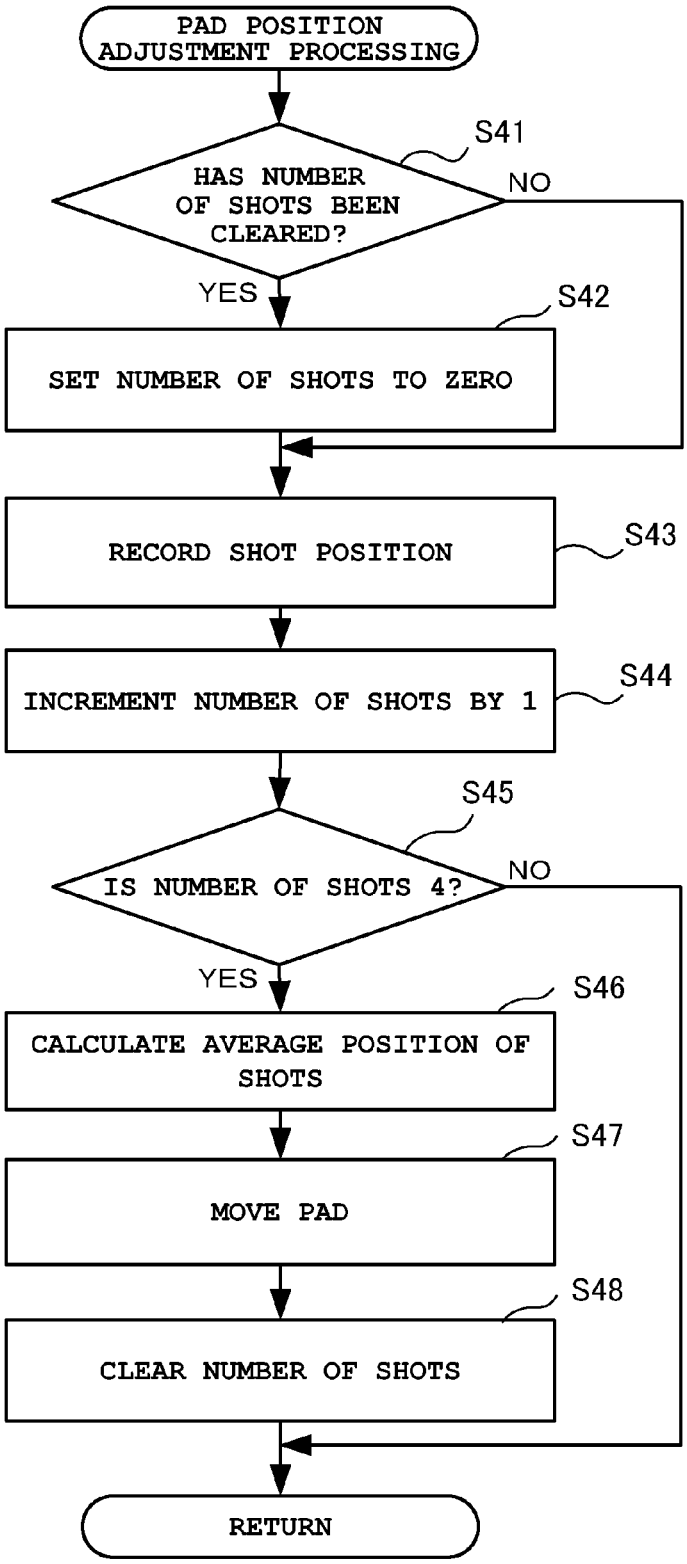
FIG. 11 is a flowchart of pad position adjustment processing by the center unit section.

When judged at Step S27 that pad position adjustment is in progress, the CPU 31 performs pad position adjustment processing described hereafter with reference to FIG. 11 (Step S28), and judges whether or not a pad position has been determined (Step S29). When a pad position determination flag described hereafter is ON, the CPU 31 judges that a pad position has been determined. When the pad position determination flag is OFF, the CPU 31 judges that a pad position has not been determined.

When judged that a pad position has not been determined, the CPU 31 returns to the processing at Step S21. When judged that a pad position has been determined, the CPU 31 turns OFF the pad position adjustment flag and the pad position determination flag (Step S30) and then returns to the processing at Step S21.

At Step S27, when judged that pad position adjustment is not in progress, the CPU 31 performs shot information processing (Step S31). In this processing, the CPU 31 reads out musical tone data (waveform data) associated with a virtual pad 81 in an area where position coordinates included in the marker detection information are located, from set layout information read out to the RAM 33, and outputs the musical tone data and sound volume data included in the note-ON event to the sound source device 36. Then, the sound source device 36 emits the corresponding musical sound based on the received waveform data. In addition, the virtual pad 81 in the area where the position coordinates included in the marker detection information are located is set as a target of pad position adjustment in the pad position adjustment processing described hereafter with reference to FIG. 11. Moreover, a virtual pad 81 which has become a target of pad position adjustment in the preceding processing at Step S31 is excluded from pad position adjustment. As a result, the most recently struck virtual pad 81 becomes a target of pad position adjustment. When the processing at Step S31 is completed, the CPU 31 returns to the processing at Step S21.

[Pad Position Adjustment Processing by the Center Unit Section 30]

FIG. 11 is a flowchart showing a detailed flow of the pad position adjustment processing at Step S28 in the center unit section processing in FIG. 10.

As shown in FIG. 11, first, the CPU 31 judges whether or not the number of shots has been cleared (Step S41). When judged that the number of shots has been cleared, the CPU 31 sets the number of shots to zero (Step S42).

When judged at Step S41 that the number of shots has not been cleared or when the processing at Step S42 is completed, the CPU 31 records a shot position based on the marker detection information (Step S43). The shot position herein is position coordinates within an image captured by the camera unit section 20 at a shot timing. In the present embodiment, position coordinates within a captured image coincide with position coordinates on the virtual plane, as described above.

Next, the CPU 31 increments the number of shots by 1 (Step S44), and judges whether or not the value of the number of shots is 4 (Step S45). When judged that the value of the number of shots is not 4, the CPU 31 ends the pad position adjustment processing.

When judged that the value of the number of shots is 4, the CPU 41 calculates the average position of the shot positions (Step S46). In this processing, the CPU 31 calculates the average position coordinates of the four shot positions. Next, the CPU 31 moves the virtual pad 81 which is a target of pad position adjustment to a position on the virtual plane determined by the calculated average position coordinates, and the CPU 31 turns ON the pad position determination flag (Step S47).

Then, the CPU 31 clears the number of shots (Step S48) and ends the pad position adjustment processing.

[Overview of Pad Position Adjustment]

Figure 12:
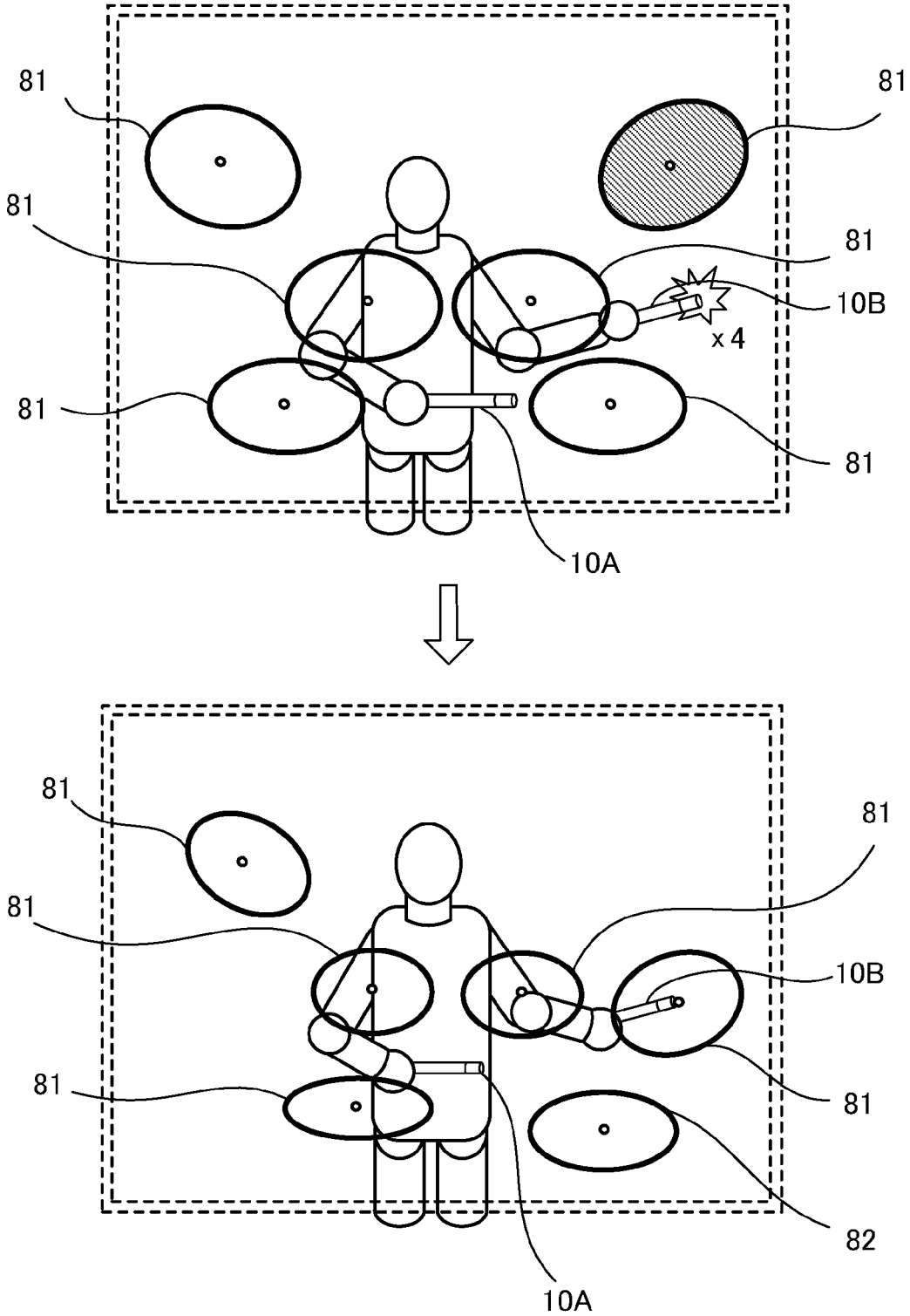
FIG. 12 is a diagram showing an example of pad position adjustment.

FIG. 12 is an example of pad position adjustment. In the example of FIG. 12, a virtual pad 81 most recently struck with the pad position adjustment flag turned. OFF has been designated as a target of pad position adjustment, arbitrary positions on the virtual plane have been struck four times, and the virtual pad 81 designated as a target of pad position adjustment has been moved to the average position of the positions struck four times, as described in the descriptions of the center unit section processing and the pad position adjustment processing.

The structure and processing of the musical performance device 1 of the present embodiment are as described above.

In the present embodiment, when position coordinates detected at a shot timing are within one of the areas of the plurality of virtual pads 81, the CPU 31 designates a virtual pad 81 in an area where the position coordinates are located as a target of positional change. Then, the CPU 31 determines a position where the virtual pad 81 designated as a target of positional change is placed by this positional change, based on position coordinates detected at shot timings, and changes the position of the virtual pad 81 designated as a target of positional change to the determined position.

That is, a virtual pad 81 struck by the instrument player is set as a target of positional change, and a position where the virtual pad 81 is placed by this positional change is determined based on struck positions. As a result of this configuration, the position of a virtual pad 81 can be changed by an intuitive operation.

In addition, since the virtual pads 81 can be placed in desired positions, musical performance can be easily performed. Moreover, musical performance that is not possible with an ordinary drum set can be performed.

Also, in the present embodiment, the drumstick section 10 includes the switch 171 for switching a musical performance mode in which an instruction to generate a musical sound is given to a position change mode in which a position where a virtual pad 81 is placed by its positional change is determined and the position of the virtual pad 81 is changed to the determined position. The CPU 31 designates a virtual pad 51 to be a target of positional change at the most recent shot timing in the musical performance mode, and determines a position where the designated virtual pad 81 is placed by this positional change, on a condition that the musical performance mode has been switched to the position change mode by the operation of the switch 171.

That is, a virtual bad 81 most recently struck in the musical performance mode is always set as a target of positional change. As a result of this configuration, the instrument player can easily designate a virtual pad 81 to be a target of positional change.

Moreover, in the present embodiment, the CPU 31 counts the number of times position coordinates at a shot timing are detected in the position change mode. Then, when the counted number of times reaches four, the CPU 31 determines a position where a virtual pad 81 is placed by its positional change, based on the average value of the four position coordinates.

Accordingly, even if the four shot positions slightly vary, the virtual pad 81 can be changed to the desired position. In addition, even if the first shot position does not coincides with the desired position, the instrument player can the position of the virtual pad 81 to the desired position by swinging the drumstick section 10 such that the second and subsequent shot positions come closer to the desired position.

Note that although the above-described embodiment has been described using the virtual drum set D (see FIG. 1) as a virtual percussion instrument, the present invention is not limited thereto, and may be applied to other musical instruments such as a xylophone which emit musical sound by a downward swing movement of the drumstick section 10.

In addition, although the number of shots for changing the position of a virtual pad 31 is four in the above-described embodiment, the present invention is not limited thereto, and the number of shots may be one to three, or more than five.

While the present invention has been described with reference to the preferred embodiments, it is intended that the invention be not limited by any of the details of the description therein but includes all the embodiments which fall within the scope of the appended claims.

What is claimed is:

1. A musical performance device comprising:

a musical performance component which is operable on a virtual plane;

a position detecting section which detects position coordinates of the musical performance component on the virtual plane;

a storage section which stores layout information including positions of a plurality of areas arranged on the virtual plane and musical tones respectively associated with the plurality of areas;

a mode specifying section which specifies one of a position change mode and a musical performance mode;

a certain operation position detecting section which detects a position of the musical performance component on the virtual plane when a certain operation is performed by the musical performance component;

a judging section which judges whether the position of the musical performance component detected by the certain operation position detecting section is within any one of the plurality of areas arranged based on the layout information;

a sound generation instructing section which, when the judging section judges that the position of the musical performance component is within one area of the plurality of areas in the musical performance mode, gives an instruction to emit a musical sound of a musical tone associated with the one area; and a position changing section which, when the judging section judges that the position of the musical performance component is within a given area of the plurality of areas in the position change mode, changes a position of the given area based on the position coordinates detected by the position detecting section, and changes the layout information stored in the storage section based on the changed position;

wherein, when a number of times that the certain operation position detection section detects the position of the musical performance component in an arbitrary area on the virtual plane reaches a predetermined number of times, the position changing section changes the position of the given area based on the position of the musical performance component in the arbitrary area detected the predetermined number of times by the certain operation position detecting section.

2. A non-transitory computer-readable storage medium having stored thereon a program that is executable by a computer of a musical performance device including a musical performance component which is operable on a virtual plane, a position detecting section which detects position coordinates of the musical performance component on the virtual plane, a storage section which stores layout information including positions of a plurality of areas arranged on the virtual plane and musical tones respectively associated with the plurality of areas, and a mode specifying section which specifies one of a position change mode and a musical performance mode, the program being executable by the computer to perform functions comprising:

certain operation position detection processing for detecting a position of the musical performance component on the virtual plane when a certain operation is performed by the musical performance component;

judgment processing for judging whether the detected position of the musical performance component is within any one of the plurality of areas arranged based on the layout information;

sound generation instruction processing for, when the position of the musical performance component is judged to be within one area of the plurality of areas by the judgment processing in the musical performance mode, giving an instruction to emit a musical sound of a musical tone associated with the one area; and position change processing for, when the position of the musical performance component is judged to be within a given area of the plurality of areas in the position change mode, changing a position of the given area based on the position coordinates detected by the position detecting section, and changing the layout information stored in the storage section based on the changed position;

wherein, when a number of times that the certain operation position detection processing detects the position of the musical performance component in an arbitrary area on the virtual plane reaches a predetermined number of times, the position change processing changes the position of the given area based on the position of the musical performance component in the arbitrary area detected the predetermined number of times by the certain operation position detecting processing.

3. A method of controlling a musical performance device including a musical performance component which is operable on a virtual plane, a position detecting section which detects position coordinates of the musical performance component on the virtual plane, a storage section which stores layout information including positions of a plurality of areas arranged on the virtual plane and musical tones respectively associated with the plurality of areas, and a mode specifying section which specifies one of a position change mode and a musical performance mode, the method comprising:

detecting a position of the musical performance component on the virtual plane when a certain operation is performed by the musical performance component;

judging whether the detected position of the musical performance component is within any one of the plurality of areas arranged based on the layout information;

giving an instruction to, when the position of the musical performance component is judged to be within one area of the plurality of areas in the musical performance mode, emit a musical sound of a musical tone associated with the one area; and changing, when the position of the musical performance component is judged to be within a given area of the plurality of areas in the position change mode, a position of the given area based on the position coordinates detected by the position detecting section, and changing the layout information stored in the storage section based on the changed position;

wherein, when a number of times that the detecting detects the position of the musical performance component in an arbitrary area on the virtual plane reaches a predetermined number of times, the changing changes the position of the given area based on the position of the musical performance component in the arbitrary area detcted the predetermined number of times by the detecting.

* * * * *